United States Patent [19]

Walters

[11] Patent Number: 4,510,870

[45] Date of Patent: Apr. 16, 1985

[54] CHARGE LINER CONSTRUCTION AND METHOD

[75] Inventor: William P. Walters, Newark, Del.

[73] Assignee: The United States of America as represented by the Secretary of the Army, Washington, D.C.

[21] Appl. No.: 286,744

[22] Filed: Jul. 27, 1981

[51] Int. Cl.[3] ..... F42B 1/00

[52] U.S. Cl. ..... 102/307; 102/309; 102/321; 102/331; 102/332; 102/476

[58] Field of Search ..... 102/306–310, 102/476, 332, 331, 321

[56] References Cited

U.S. PATENT DOCUMENTS

| | | | |
|---|---|---|---|
| 3,112,701 | 12/1963 | Grebe | 102/306 |
| 3,154,014 | 10/1964 | Dunne | 102/308 |
| 3,235,005 | 2/1966 | Delacour | 102/306 X |
| 3,311,055 | 3/1967 | Stresau, Jr. et al. | 102/306 X |
| 3,327,630 | 6/1967 | Bell | 102/306 X |
| 3,732,816 | 5/1973 | Muller | 102/306 X |
| 4,020,765 | 5/1977 | Glass et al. | 102/499 X |
| 4,080,898 | 3/1978 | Gieske | 102/306 X |

FOREIGN PATENT DOCUMENTS

| | | | |
|---|---|---|---|
| 1432578 | 2/1966 | France | 102/476 |

*Primary Examiner*—Peter A. Nelson

*Attorney, Agent, or Firm*—Anthony T. Lane; Robert P. Gibson; Edward F. Costigan

[57] ABSTRACT

A method of reducing the velocity gradient of a shaped charge liner is disclosed. A particular construction for the liner is also disclosed which has the same effect. The velocity gradient and jet-tip velocity are both reduced by forming a plurality of relatively small diameter holes in the charge liner before the liner is assembled with the remaining components of an explosive device.

11 Claims, 5 Drawing Figures

CHARGE LINER CONSTRUCTION AND METHOD

The invention described herein may be manufactured, used and licensed by or for the Government for Governmental purposes without payment to the inventor of any royalties thereon.

FIELD OF THE INVENTION

The present invention relates in general to explosive devices and, in particular to a new and useful technique in the preparation of shaped charge liners of explosive devices which reduce the velocity gradient of the shaped charge liner as the device is detonated.

DESCRIPTION OF THE PRIOR ART

It is known to utilize specially shaped charge liners in explosive devices, particularly mines and the like, which, upon detonation of the explosive device, break up into individual particulate projectiles. Upon detonation of the explosive device, a velocity gradient is formed as the pressure of the exploding charge forces the liner outwardly. The liner eventually breaks up into particles which are either solid or molten which fly out according to the velocity gradient.

Various techniques and constructions for the shaped charge are known which selectively regulate the jet velocity gradient and the so-called jet-tip velocity. These techniques include tapering the wall thickness of the shaped charge liner, varying the shape of a shaped liner having a uniform wall thickness, varying the geometry or kind of explosive charge used in the device for propelling the charge liner, varying the material of the confining body used in the explosive device, varying the geometry of the confining body, or altering the material or materials of the liner. All of these prior art techniques involve major modifications to the explosive device or warhead assembly operation.

SUMMARY OF THE INVENTION

The present invention comprises a method of making a shaped charge liner, and shaped charge liners themselves which are made according to the inventive method which have a reduced jet tip velocity gradient and reduced jet tip velocity. According to the invention, relatively small diameter holes are drilled or otherwise formed in the shaped charge liner to be used. Preferably, these holes are formed in the liner before assembly of the explosive device and inclusion of the explosive charge material. Explosive devices including such liners having holes have been found to have a reduced velocity gradient and thus be more effective against targets, such as armored vehicles and the like, which consist of spaced plates that are inclined at some angle to the jet path of the exploding device.

The inventive technique has been found to slow down the overdriven jets, to alter the velocity gradient of any of the jets to increase its breakup time and/or improve its performance, to form rod-like or elongated jets, and to allow main jets of the velocity gradient to travel slower than their associated precursor jets, if the main jets overtake their respective precursor jet.

A primary advantage of the invention is that the jet tip velocity and velocity gradient are reduced in an extremely simple and effective manner with only minor alterations in standard and known liner designs and methods of construction.

In one preferred form of the invention, a plurality of spaced holes are drilled through the liner, in a symmetrical pattern around a circumference of the liner. The holes are drilled prior to the assembly of the warhead or explosive device, or prior to loading of the explosive device with an explosive load or charge. This technique is far less expensive and much simpler than prior art techniques for achieving the same result. The number of holes and their location around the circumference of the liner determines the resultant velocity and velocity gradient of the shaped charge jet.

According to another feature of the invention, the holes may be positioned in a non-symmetrical manner. This results in a shaped charge jet which forms at an angle to the axis of symmetry of the charge. This technique can be used in producing an explosive device which is particularly effective against tanks in top-attack applications or to reduce the effective target obliquity.

According to another embodiment of the invention, an excess of such holes can be provided along an azimuthal plane, that is a plane which is perpendicular to a central axis of a concave liner and one which extends through a portion of the liner. With such provision of holes, the jet breaks at the azimuthal plane and forms two or more rod-like particles.

In assembling the explosive device using the inventive method and charge liner, the holes may be covered with tape or the like which is resistant to the explosive charge. The tape is positioned on a side of the liner which is to face the charge and is provided for the purposes of preventing the charge from filling the holes or otherwise leaking from the explosive device casing.

The inventive technique may be applied to any form of known shaped charge liner including but not limited to hemispherical liners, conical liners, Misnay-Chardin type liners, or any other usually arcuate shaped liners.

Accordingly, an object of the invention is to provide a method of reducing velocity gradient and in particular jet tip velocity of a shaped charge liner which comprises the formation of relatively small diameter holes in a pattern in the liner before the explosive device carrying the liner is detonated.

Another object of the invention is to provide such holes in a symmetrical or asymmetrical pattern on the liner to selectively regulate the velocity gradient thereof.

A further object of the invention is to provide such a method which is useful in reducing the velocity gradient in both uniform and non-uniform walled concave liners, including hemispherical liners, conical liners, truncated hemispherical liners, hemi-cone liners, tapered hemispherical liners, self forging fragment liners, ballistic discs, Misnay-Chardin liners, and tapered conical liners.

A still further object of the invention is to provide such a method and the liners constructed according to such a method which include holes having diameters in the range which is preferably between about 0.7 mm (or 0.027 in) and up to about four times the wall thickness of the liner.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
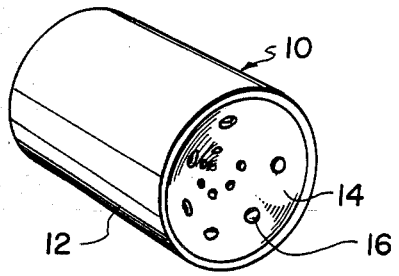
FIG. 1 is a perspective view showing a pattern of holes positioned in a charge liner of an explosive device according to the invention.

Turning to the drawings in particular, the invention embodied therein, in FIG. 1 comprises, an explosive device generally designated 10 which comprises a casing 12 filled with an explosive charge. The explosive charge is confined in casing 12 by a shaped charge liner 14 including a plurality of spaced holes 16 distributed in a pattern on the charge liner 14.

Figure 2:
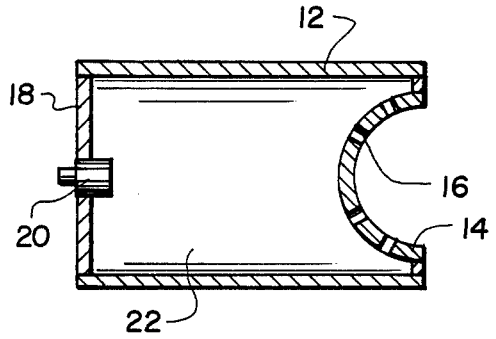
FIG. 2 is a side sectional view taken through an explosive device incorporating the inventive charge liner.

As shown in FIG. 2, the casing 12 includes a base portion 18 which has a detonator and booster assembly 20 for detonating the explosive charge 22 held within the casing 12. Charge liner 14 is mounted to the casing 12 in any known fashion to confine the explosive charge.

Upon detonation of detonator and booster 20, the explosive charge 22 ignites and collapses the charge liner out into a characteristic velocity gradient. Shortly thereafter, the liner 14 breaks up into molten or solid particles.

According to the invention, the provision of holes, such as holes 16, in a charge liner, reduces the pressure exerted on the liner by the exploding charge and thus reduces the velocity gradient. In particular the jet tip velocity is reduced.

Figure 4:
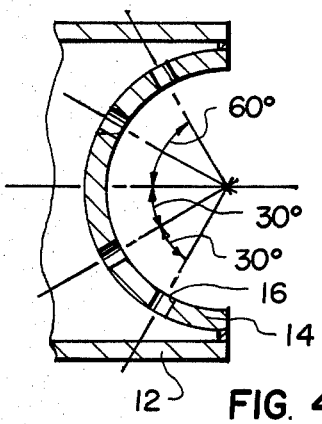
FIG. 4 is a front elevational view of the liner illustrated in FIG. 3.
Figure 3:
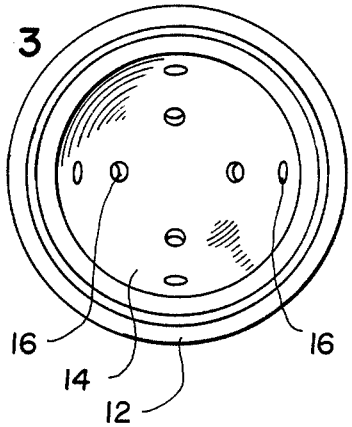
FIG. 3 is an enlarged fragmentary portion of the embodiment shown in FIG. 2 which illustrates a preferred configuration of the hole pattern.

Turning to FIGS. 3 and 4, a preferred pattern of the holes is shown for a hemispherical liner 14. The holes are spaced apart by 90° around the azimuth of the liner as shown in FIG. 4 with, four holes drilled at a 30° polar angle and four holes drilled at a 60° polar angle. In a successful test configuration, $\frac{1}{8}$th inch diameter holes were provided in a 5 inch outside diameter hemisphere having a 0.08 inch wall thickness. The casing 12 was 7.5 inches high and was made of a $\frac{1}{8}$th inch thick cylindrical aluminum body. The explosive charge was 75/25 octol high explosive. With the holes located as shown in FIGS. 3 and 4, the jet tip velocity was 3.49 kilometers per second whereas the jet tip velocity of the identical warhead without the holes was 3.81 kilometers per second. This demonstrates that the holes provided in the liner reduce the jet velocity. In addition, the resulting shaped charge jet revealed no evidence of the presence of the holes in the liner. That is, the jet appeared to be identical to a standard hemispherical jet made by a liner without the holes. Early time flash radiographs of the jet formation process confirmed the fact that the jet formation was not disturbed.

Other hole sizes and configurations can be utilized according to the invention. Smaller diameter holes will minimize the effect. Larger diameter holes for example, $\frac{1}{4}$ inch, will destroy the jet formation for this particular design. A large number of holes in the polar or azimuthal direction will further reduce the jet tip velocity and alter the jet velocity gradient. An excess of holes in an azimuthal plane, shown for example at 24 in FIG. 5, will cause the jet to neck down at that point and break. Thus an excess of holes can be used to induce a preferential breakup or particulation of the shaped charge jet.

While a particular embodiment of the invention is shown in FIGS. 3 and 4 which utilizes a hemispherical liner, the invention can also be applied to other types of warhead liners and liner geometrics such as tapered hemispherical liners, truncated hemispherical liners, self forging fragment liners, ballistic discs, Misnay-Chardin liners, conical liners and in particular all arcuate shaped liners which are concave when viewed from outside the device. The liner can be constructed of any material capable of forming a coherent jet, such as copper, aluminum or steel, as is well known in the art.

As noted above, the provision of holes in the liner will increase the performance of the warhead or explosive device utilizing the liner against targets consisting of spaced plates inclined at angles of obliquity to the jet path. Such targets include armored vehicles, tanks and the like. A more advantageous velocity distribution in the jet is provided by slowing down the front portion of the jet without altering the velocity of the rear portion of the jet. A main jet designed to follow a secondary or precursor jet is slowed down according to the invention if the main jet overtakes the precursor jet prior to impact with the target. The provision of excess holes along the azimuthal plane will cause the jet to particulate into definite sections which are predetermined by the location of the holes. In this way, two or more segments in the jet having a longer length than any individual particulated jet particle can be formed. For example, the provision of holes will allow the liner to particulate into two or more rod-like segments instead of several smaller particles. Jets consisting of rod-like particles are advantageous for certain standoff distances and target applications.

Figure 5:
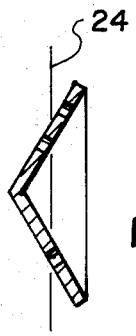
FIG. 5 is a sectional view taken through a charge liner which can be used in conjunction with the invention.

By using asymmetrical distribution of holes, a lower pressure condition is established in the area of holes which causes a jet flow at an angle toward this concentration of holes and away from the axis of symmetry of the device. The angle is determined by the number of holes. FIG. 5 for example shows a higher concentration of holes in the upper half of the conical liner plate than in the lower half.

In general, the holes occupy between 0.00001% and about 5%, and preferably between about 0.01% and about 1.0% of the total volume of the liner, although this can vary depending on the geometry of the liner and the material used to fabricate the liner.

While specific embodiments of the invention have been shown and described in detail to illustrate the application of the principles of the invention, it will be understood that the invention may be embodied otherwise without departing from such principles.

I claim:

1. In the method of reducing the jet-tip velocity gradient of an exploding shaped-charge concave liner, the improvement consisting essentially of forming a plurality of holes in spaced relation around the central axis of said liner during construction of said explosive device incorporating said liner, distributing said holes at polar angles of 30 and 60 degrees and at azimuthal angles of 90 degrees to each other.

2. The method of claim 1 wherein said holes occupy from 0.00001 to 5.0 percent of the total liner volume.

3. The method of claim 1 wherein said holes are distributed symmetrically about the central axis of said liner.

4. The method of claim 1 wherein said holes are distributed asymmetrically about the central axis of said liner.

5. The method of claim 1 wherein said holes are distributed in a pattern having a concentration of said holes at a selected azimuthal range of said liner.

6. In a shaped-charge explosive device provided with a liner having a central axis, the improvement consisting essentially of having said liner provided with a plurality of spaced apart holes therethrough distributed in a pattern around said central axis of said liner at polar angles of 30 and 60 degrees and at azimuthal angles of 90 degrees to each other.

7. The shaped-charge of claim 6 wherein said holes occupy from 0.00001 to 5.0 percent of the total volume of said liner.

8. The shaped-charge of claim 6 wherein said holes are distributed symmetrically about the central axis of said liner.

9. The shaped-charge of claim 6 wherein said holes are distributed asymmetrically about the central axis of said liner.

10. The shaped-charge of claim 6 wherein said pattern having a concentration of said holes at a selected azimuthal range of said line.

11. The shaped-charge of claim 6 wherein said liner is selected from the group consisting of hemispherical liners, tapered hemispherical liners, conical liners, tapered conical liners, self-forging fragment lines, and Mesnay-Chardin liners.

* * * * *